US008523173B2

(12) United States Patent
Hayayumi

(10) Patent No.: US 8,523,173 B2
(45) Date of Patent: Sep. 3, 2013

(54) SHEET FEEDER AND IMAGE FORMING APPARATUS

(75) Inventor: Fumihiko Hayayumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/524,457

(22) Filed: Jun. 15, 2012

(65) Prior Publication Data

US 2012/0326382 A1 Dec. 27, 2012

(30) Foreign Application Priority Data

Jun. 24, 2011 (JP) ..... 2011-140345

(51) Int. Cl.
*B65H 3/06* (2006.01)

(52) U.S. Cl.
USPC ..... 271/117; 271/124; 271/121

(58) Field of Classification Search
USPC ..... 271/117, 121, 122, 123, 124, 125
See application file for complete search history.

(56) References Cited

U.S. PATENT DOCUMENTS

| | | | | |
|---|---|---|---|---|
| 4,509,737 | A * | 4/1985 | Shiozawa | 271/125 |
| 4,526,358 | A * | 7/1985 | Ura et al. | 271/34 |
| 4,572,498 | A * | 2/1986 | Shiozawa | 271/34 |
| 6,485,015 | B2 * | 11/2002 | Yen et al. | 271/121 |
| 6,862,426 | B2 * | 3/2005 | Kitamura | 399/393 |
| 8,113,505 | B2 * | 2/2012 | Lee | 271/167 |
| 8,132,809 | B2 * | 3/2012 | Shiraishi et al. | 271/162 |
| 2006/0237895 | A1 | 10/2006 | Nishikata et al. | |
| 2012/0126475 | A1 * | 5/2012 | Shin et al. | 271/117 |

* cited by examiner

*Primary Examiner* — Kaitlin S Joerger
*Assistant Examiner* — Ernesto Suarez
(74) *Attorney, Agent, or Firm* — Fitzpatrick, Cella, Harper & Scinto

(57) ABSTRACT

The present invention provides a sheet feeder and an image forming apparatus that can prevent a sheet from being broken, bent, or remaining in an apparatus when a sheet containing portion is pulled out.

In association with a cassette pulling operation, a separation mechanism separates a separation roller that is brought into press-contact with a feed roller in a manner in or out of contact with the feed roller, and lowers a lifter plate. A restricting portion constituted of a feed roller separation arm and a feed roller separation spring restricts the feed roller being applied a force by a feed roller pressurizing spring from following the separation roller separated from the feed roller and the lowering lifter plate when the cassette is pulled out.

8 Claims, 7 Drawing Sheets

SHEET FEEDER AND IMAGE FORMING APPARATUS

BACKGROUND OF THE INVENTION

1. Field of the Invention

The present invention relates to a sheet feeder and an image forming apparatus and, more particularly, to a configuration in which a sheet feeding force can be prevented from being markedly reduced even in the case where an amount of stacked sheets is increased or sheets having a great density are stacked.

2. Description of the Related Art

An image forming apparatus, such as a printer or a copying machine, has been conventionally provided with a sheet feeder including a sheet feeding cassette serving as a sheet container of a feeding type, on which sheets are stacked, and a feeding portion which feeds the sheets contained in the sheet feeding cassette one by one in separation.

The above-described sheet feeder is exemplified by a sheet feeder provided with a feed roller which feeds sheets and a separation roller which separates the sheets in abutment against the feed roller. In a sheet feeding cassette disclosed in U.S. Patent Application Publication No. 2006/237895 A1, a lifter plate having sheets stacked thereon is disposed in a removable manner in a vertical direction, and further, the lifter plate is urged by a spring to bring the sheet into press-contact with the feed roller, thereby generating a feeding force. When the sheet is fed, the feed roller is rotated in press-contact with an uppermost sheet stacked on the lifter plate so that the uppermost sheet is fed. After that, the fed uppermost sheet is allowed to pass a nip interposed between the feed roller and the separation roller. In this manner, the sheets are fed one by one in separation.

In the above-described sheet feeder provided with the sheet feeding cassette such configured that the lifter plate is urged so as to generate the sheet feeding force, the weight of the sheets stacked on the lifter plate is increased in the case where an amount of the stacked sheets is increased or sheets having a great density are stacked. When the weight of the sheets is increased in such a manner, the weight reduces the resiliency of the spring, and therefore, a pressing pressure between the feed roller and the sheet is decreased, thereby raising a fear of instability of the sheet feeding force of the feed roller.

In view of the above-described present circumstances, the present invention has been accomplished to solve the above-described problems experienced in the prior art. Therefore, the present invention provides a sheet feeder and an image forming apparatus, in which a sheet feeding force can be prevented from being markedly reduced even in the case where an amount of stacked sheets is increased or sheets having a great density are stacked.

SUMMARY OF THE INVENTION

A sheet feeder according to the present invention includes: a sheet containing portion that has a sheet stacking portion to be lifted and lowered and that is detachably attached to an apparatus body; a feed roller that is located above the sheet stacking portion in a manner movable in a vertical direction so as to feed sheets stacked on the sheet stacking portion; a feed roller biasing portion that applies a force to the feed roller in a direction in which the feed roller is brought into press-contact with the sheets stacked on the sheet stacking portion; a separation member that is brought into press-contact with the feed roller so as to separate the sheets fed by the feed roller one by one; a separating portion that separates the separation member from the feed roller in association with a pulling operation of the sheet containing portion from the apparatus body; a lifting and lowering portion that lifts the sheet stacking portion in such a manner that an upper surface of the sheet is located at a predetermined height during a sheet feeding operation whereas lowers the sheet stacking portion in association with the pulling operation of the sheet containing portion when the sheet containing portion is pulled out of the apparatus body; and a restricting portion that restricts the feed roller being applied a force by the feed roller biasing portion from following the separation member separated from the feed roller and the lowering sheet stacking portion when the sheet containing portion is pulled out of the apparatus body.

According to the present invention, a sheet stack portion is lowered as a force is applied to a feed roller such that a sheet feeding force of the feed roller can be prevented from being markedly reduced even in the case where an amount of stacked sheets is increased or sheets having a great density are stacked.

Further features of the present invention will become apparent from the following description of exemplary embodiments with reference to the attached drawings.

DESCRIPTION OF THE EMBODIMENTS

Figure 1:
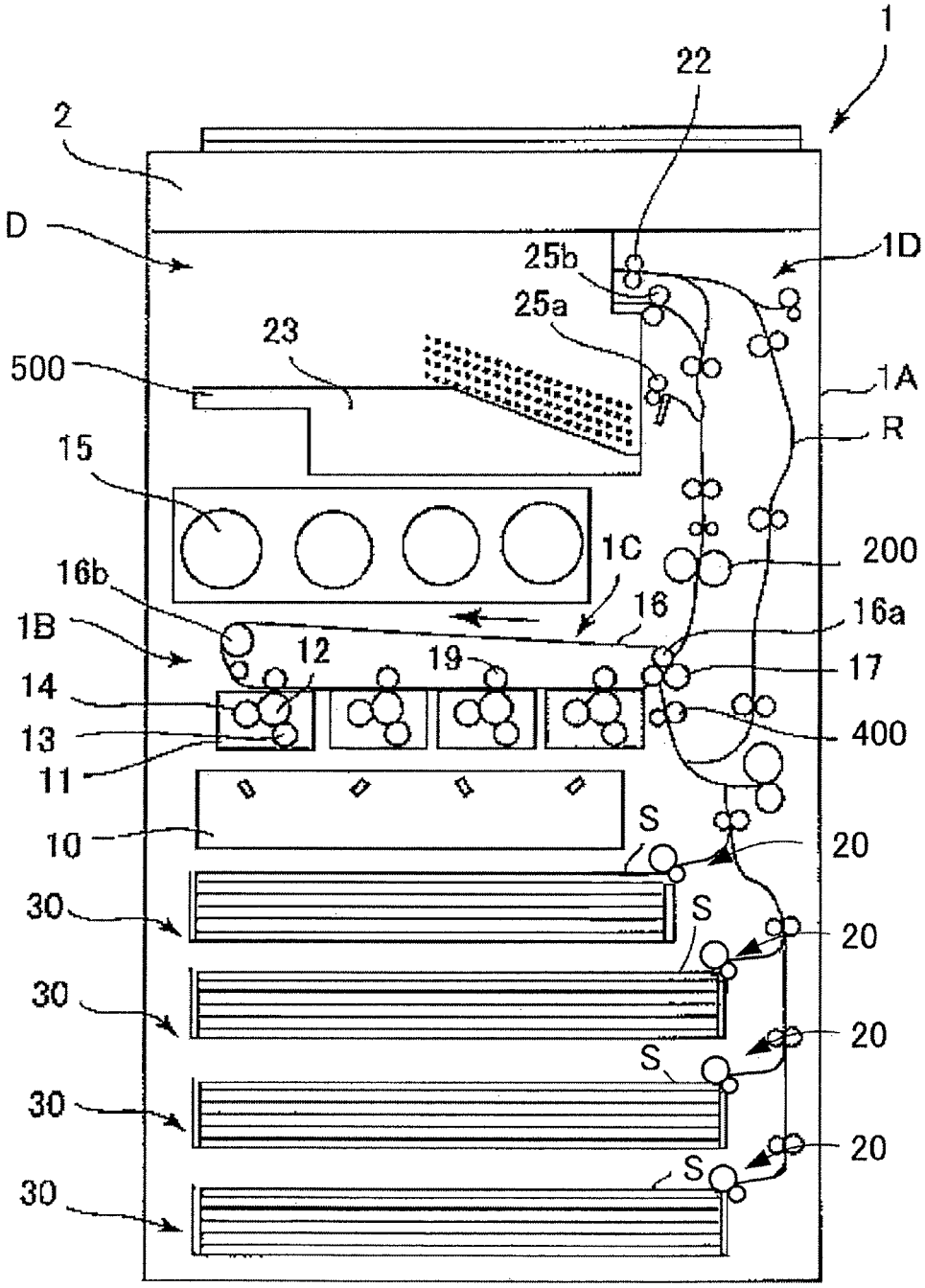
FIG. 1 is a view schematically illustrating the configuration of a full-color laser beam printer exemplifying an image forming apparatus provided with a sheet feeder in a first embodiment according to the present invention.

A detailed description of embodiments according to the present invention with reference to the attached drawings will be given below. FIG. 1 is a view schematically illustrating the configuration of a full-color laser beam printer exemplifying an image forming apparatus provided with a sheet feeder in a first embodiment according to the present invention.

In FIG. 1, a full-color laser beam printer (hereinafter referred to as a "printer") 1 includes a printer body 1A serving as an image forming apparatus body and an image forming portion 1B which forms an image on a sheet. An image reading apparatus 2 is disposed substantially horizontally above the printer body 1A. A sheet discharging space D is defined between the image reading apparatus 2 and the printer body 1A.

Furthermore, the printer 1 further includes sheet feeders 20 which feed sheets and toner cartridges 15.

The image forming portion 1B is of a four-drum full color system, including a laser scanner 10 and four process cartridges 11 which form toner images with four colors, that is, yellow (Y), magenta (M), cyan (C), and black (K). Here, each of the process cartridges 11 is provided with a photosensitive drum 12, a charger 13 serving as an electric charging portion, and a development device 14 serving as a developing portion. Moreover, an intermediate transfer unit 1C is disposed above the process cartridges 11.

The intermediate transfer unit 1C is provided with an intermediate transfer belt 16 stretched between a drive roller 16*a* and a tension roller 16*b* and primary transfer rollers 19 which are disposed inside of the intermediate transfer belt 16 and abut against the intermediate transfer belt 16 at positions facing the photosensitive drums 12. The intermediate transfer belt 16 is formed of a film-like member in contact with each of the photosensitive drums 12, and further, is designed to be rotated in a direction indicated by an arrow by the drive roller 16*a* to be driven by a drive portion, which not illustrated.

A transfer bias of a positive polarity is applied to the intermediate transfer belt 16 by the primary transfer rollers 19, and thus, the toner images of the colors having a negative polarity on the photosensitive drums are sequentially transferred onto the intermediate transfer belt 16 in superimposition. At a position opposite to the drive roller 16*a* in the intermediate transfer unit 1C, a secondary transfer roller 17 constituting a secondary transfer portion, in which the color images formed on the intermediate transfer belt are transferred onto a sheet S, is disposed.

Additionally, a fixing portion 200 is disposed above the secondary transfer roller 17. Furthermore, at an upper left portion of the fixing portion 200, a pair of first discharge rollers 25*a*, a pair of second discharge rollers 25*b*, and a double-sided reversing portion 1D are disposed. In the double-sided reversing portion 1D, there are provided a pair of reverse rollers 22 which can be rotated forward and reversely, a re-conveyance path R on which the sheet having the image on one side thereof is conveyed to the image forming portion 1B again, and the like.

Next, a description of an image forming operation by the printer 1 such configured as described above will be given. First, the image reading apparatus 2 reads image information on a document. The image information is then subjected to image processing, is subsequently converted into an electric signal, and then, is transmitted to the laser scanner 10 in the image forming portion 1B. Here, the image information may be input into the image forming portion 1B from outside equipment such as a personal computer, which is not illustrated.

In the image forming portion 1B, a surface of the photosensitive drum 12 in each of the process cartridges 11 is scanned with laser beams which are emitted from the laser scanner 10 and correspond to the image information on yellow, magenta, cyan, and black component colors. In this manner, the surface of the photosensitive drum 12 which is uniformly charged to a predetermined polarity and a predetermined potential by the charger 13 is sequentially exposed to the light beams. Thus, electrostatic latent images of yellow, magenta, cyan, and black colors are sequentially formed on the photosensitive drum of each of the process cartridges 11.

Thereafter, the electrostatic latent images are visually developed with toners of yellow, magenta, cyan, and black colors, and further, the toner images of the colors formed on the photosensitive drums are superimposed in sequence onto the intermediate transfer belt 16 by a primary transfer bias applied to the primary transfer rollers 19. As a consequence, the toner images are formed on the intermediate transfer belt 16.

In parallel to the above-described toner image forming operation, the sheet S is fed from the sheet feeder 20. The fed sheet S is conveyed to a pair of registration rollers 400, and then, conveyed to a secondary transfer portion while skew feeding is corrected by the pair of registration rollers 400. Thereafter, the toner images are transferred onto the sheet S by one operation by a secondary transfer bias, which is applied to the secondary transfer roller 17, in the secondary transfer portion.

Next, the sheet S having the toner images transferred thereonto in the above-described manner is conveyed to the fixing portion 200. When the sheet S receives heat and pressure in the fixing portion 200, the toners of the colors are fused and mixed so that color images are fixed onto the sheet S. After that, the sheet S having the images fixed thereto is discharged to the discharge space D by the pair of first discharge rollers 25*a* disposed downstream of the fixing portion 200, and then, is stacked on a stack portion 23 disposed in such a manner as to project at the bottom surface of the discharge space D.

When the images are formed on both sides of the sheet S, the sheet S having the image formed on either side thereof passes the fixing portion 200, and then, passes the fixing portion 200 by the pair of reverse rollers 22. Thereafter, the pair of reverse rollers 22 is rotated reversely, so that the sheet S is conveyed reversely onto the re-conveyance path R, and then, is conveyed again to the pair of registration rollers 400. After the sheet S is subjected to the image forming and fixing operations on the other side thereof, the sheet S is discharged to the discharge space D by the pair of first discharge rollers 25*a* to be thus stacked on the stack portion 23.

Figure 2A:
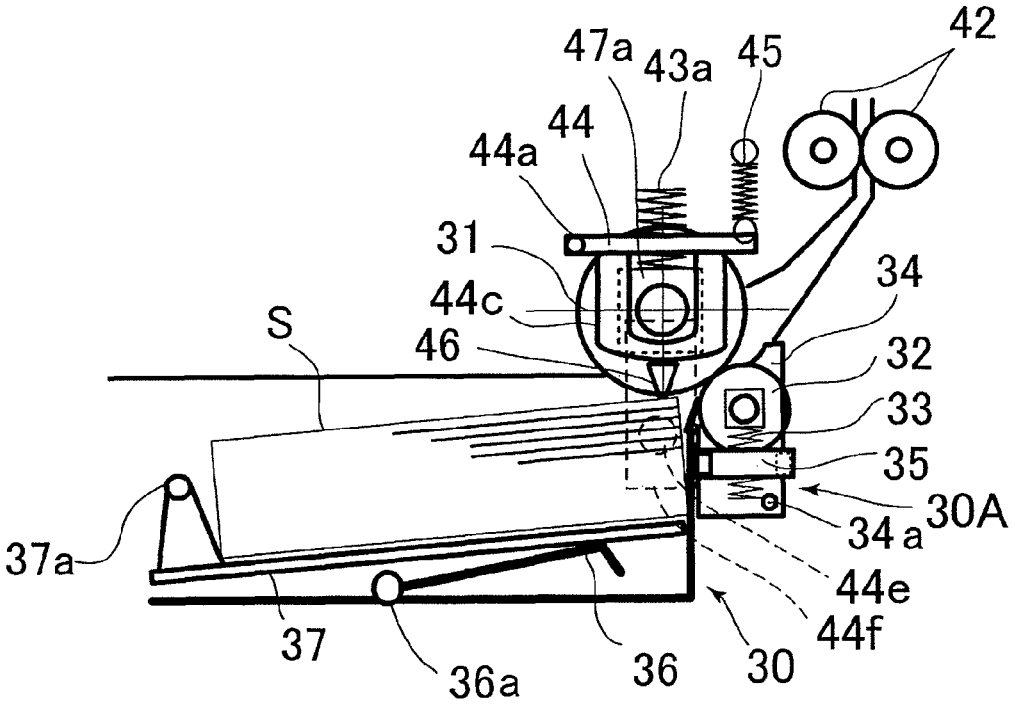
FIG. 2A is a first view illustrating the configuration of the sheet feeder.
Figure 2B:
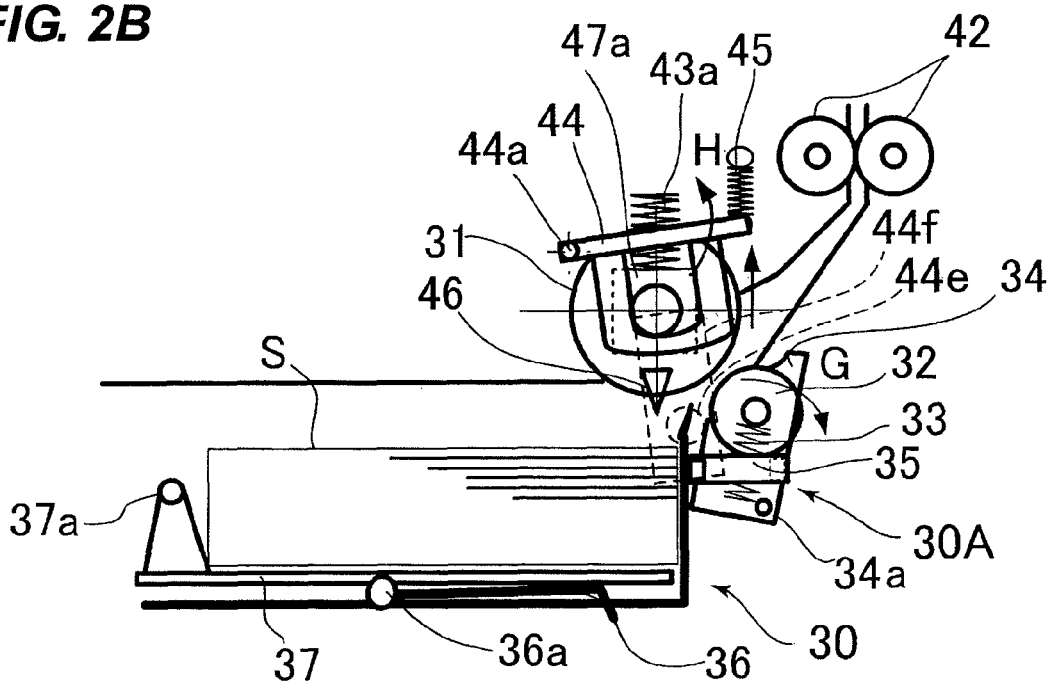
FIG. 2B is the first view illustrating the configuration of the sheet feeder.

Subsequently, a description of the configuration of the sheet feeder 20 in the present embodiment will be given with reference to FIGS. 2 to 5. Cassettes 30 are provided in the printer body 1A serving as the sheet feeder body in such a manner as to be freely (detachably) pulled. As illustrated in FIGS. 2A and 2B, a lifter plate 37 serving as the sheet stack portion, on which the sheets S are stacked, is disposed inside of each of the cassettes 30 in such a manner as to be freely turned (lifted and lowered) in a vertical direction on a fulcrum 37*a*. Moreover, the sheet feeder 20 includes a feed roller 31 that is disposed above the lifter plate 37 in such a manner as to be freely moved in the vertical direction and feeds the sheets stacked on the lifter plate 37.

As illustrated in FIGS. 2A, 2B, 5A, and 5B, a separation roller 32, which serves as a separation member provided with a torque limiter and separates the sheets one by one, is disposed downstream in a sheet feed direction of the feed roller 31 in such a manner as to be brought into press-contact with the feed roller 31. Here, a separation roller pressurizing spring 33 applies a force to the separation roller 32 toward the feed roller side, and further, a separation roller holder 34, which can be turned on a turn shaft 34*a*, rotatably supports the separation roller 32. The separation roller 32 and the feed roller 31 constitute a separation portion at which the sheets are separated and fed one by one.

The lifter plate 37 is vertically turned on the fulcrum 37*a* by a lifter arm 36 which is vertically turned on a lifter arm shaft 36*a* by the drive portion, which is not illustrated.

Figure 3A:
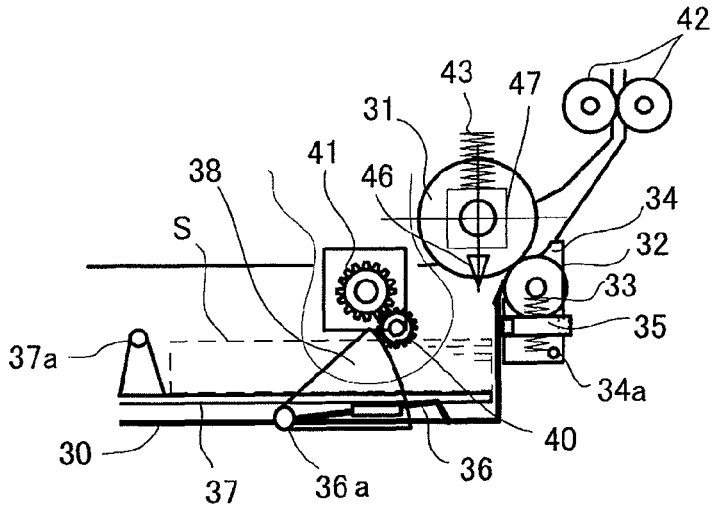
FIG. 3A PRIOR ART
FIG. 3A is a view illustrating a sheet feeder of a feed roller pressurizing system in the prior art.
Figure 3B:
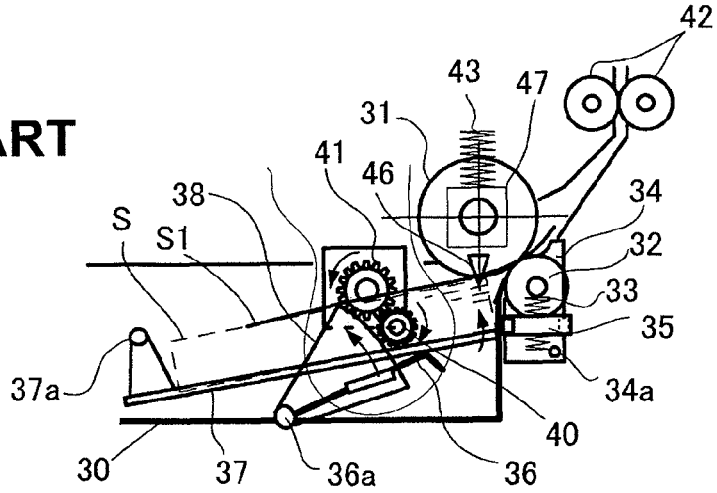
FIG. 3B PRIOR ART
FIG. 3B is a view illustrating the sheet feeder of the feed roller pressurizing system in the prior art.
Figure 3C:
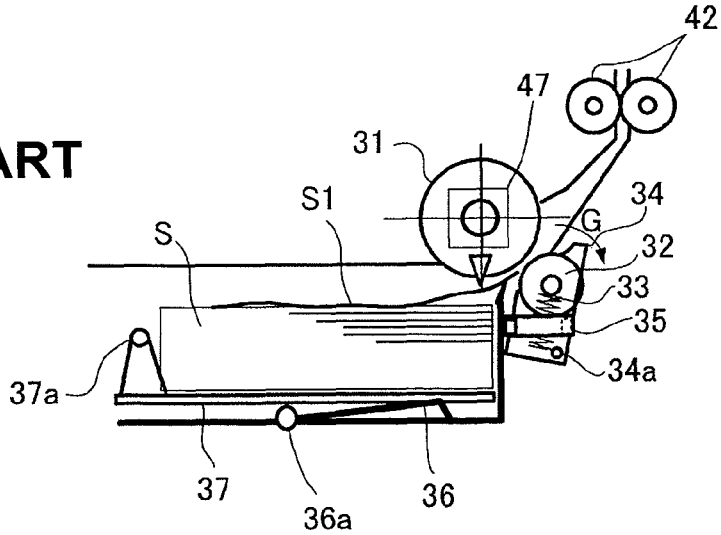
FIG. 3C PRIOR ART
FIG. 3C is a view illustrating the sheet feeder of the feed roller pressurizing system in the prior art.

Here, the lifter arm 36 is designed to be connected to a lifter lever 38 illustrated in FIGS. 3A to 3C via the lifter arm shaft 36*a*, so that the lifter arm 36 is turned on the lifter arm shaft 36*a* to lift the lifter plate 37.

Furthermore, a driving force is transmitted to the lifter lever 38 from a lifter motor 41 disposed in the printer body 1A via a lifter idler gear 40 illustrated in FIGS. 3A to 3C, thus lifting and lowering the lifter plate 37 via the lifter lever 38 and the lifter arm 36. In this manner, a lifting and lowering portion that lifts and lowers the lifter plate 37 comprises the lifter arm 36, the lifter lever 38, and the lifter motor 41.

As illustrated in FIGS. 3A to 3C, a sheet height detecting sensor 46 which detects a height of the sheets is disposed in the vicinity of the abutment position of the feed roller 31 against the sheets. A controller, which is not illustrated, is adapted to control the lifter motor 41 based on a signal output from the sheet height detecting sensor 46 in such a manner that the upper surface of an uppermost sheet S1 is in a height equal to a predetermined height.

Here, FIG. 3A illustrates the state in which the cassette 30 is inserted into the printer body. When a user inserts the cassette 30 into the printer body, the lifter motor 41 is rotated, and the lifter plate 37 is lifted as illustrated in FIG. 3B. When the sheet height detecting sensor 46 detects the upper surface of the uppermost sheet S1, the lifter motor 41 is stopped. Incidentally, the sheet height detecting sensor 46 is such configured as to detect a position at which the feed roller 31 abuts against the uppermost sheet S1 to push up the feed roller pressurizing spring 43 at a sheet feed pressure which can generate a proper feeding force.

Next, a simple description of the feeding operation by the sheet feeder in the present exemplary embodiment will be given. When a signal indicating a start of sheet feeding is output from the controller, which is not illustrated, in the printer body, the uppermost sheet S1 is fed along the rotation of the feed roller 31 to be thus introduced into a nip portion between the feed roller 31 and the separation roller 32 disposed downstream, as illustrated in FIG. 3B. At this time, in the case of one sheet S1 is fed, the separation roller 32 is rotated following the feed roller 31 and the sheet S1, and further, conveys the sheet S1 to withdrawal rollers 42 disposed downstream. In contrast, in the case of a plurality of sheets S1 is fed by the feed roller 31, a second sheet onwards are stopped at the nip portion between the feed roller 31 and the separation roller 32 by the effect of the torque limiter housed inside of the separation roller 32.

In this manner, only the uppermost sheet S1 is conveyed in separation.

Here, the lifting and lowering portion lifts the lifter lever 38 in feeding the sheet. When the cassette 30 is pulled out, as described later, the lifting and lowering portion is disconnected from the drive portion in association with a pulling operation of the cassette 30, and thus, the lifter lever 38 is lowered by its own weight or the load of the sheet.

Additionally, the lifting and lowering portion is controlled in such a manner as to lift the lifter plate 37 such that the uppermost sheet S1 can be fed at the predetermined height when the height of the uppermost sheet S1 becomes low after the sheets S are fed during the sheet feeding operation. Incidentally, when a sheet presence detecting sensor, which is not illustrated, detects that all of the sheets are fed, the controller, which is not illustrated, stops the sheet feeding operation, and displays an alarm of sheet replenishment on a panel or the like. The user pulls the cassette 30 and replenishes sheets on the cassette 30 based on the display.

Figure 4A:
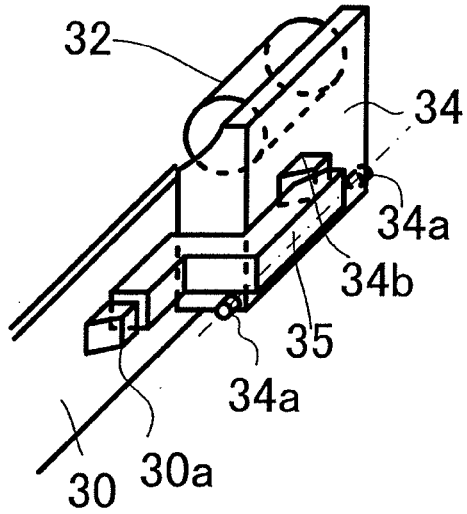
FIG. 4A PRIOR ART
FIG. 4A is a view illustrating a separating mechanism which separates a feed roller and a Separation roller from each other in the sheet feeder of the feed roller pressurizing system in the prior art.
Figure 6A:
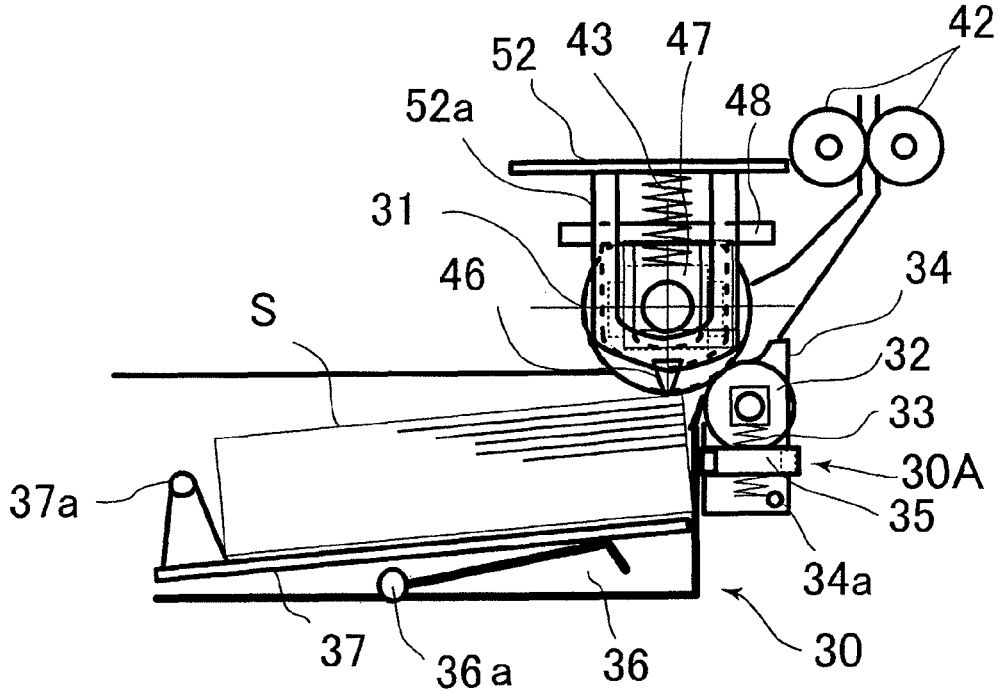
FIG. 6A is a first view illustrating the configuration of a sheet feeder in a second embodiment according to the present invention.
Figure 6B:
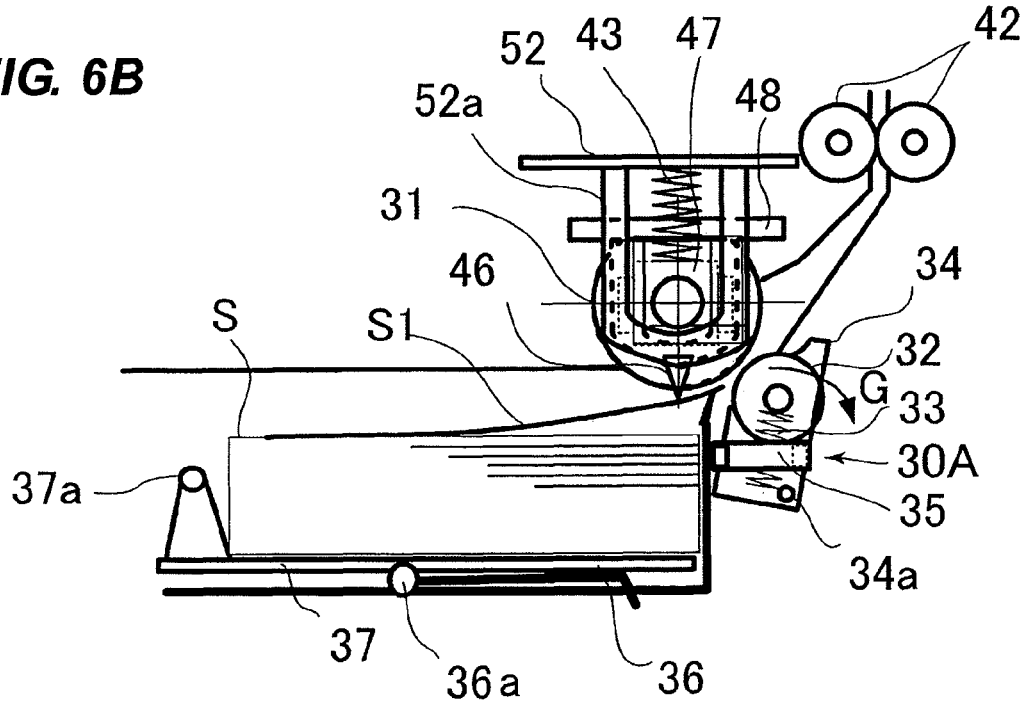
FIG. 6B is the first view illustrating the configuration of the sheet feeder in the second embodiment according to the present invention.

Here, the sheet feeder 20 in the present embodiment includes a separation mechanism 30A serving as a separation portion which separates the separation roller 32 from the feed roller 31 in association with the pulling operation of the cassette 30, as illustrated in FIGS. 6A and 6B. The separation mechanism 30A will be described below. FIG. 4A illustrates the state in which the cassette 30 is mounted in the printer body. Here, when the cassette 30 is mounted in the printer body, a separation roller separating projection 30*a* formed in the cassette 30 is adapted to press a separation roller support lever 35, which is slidably disposed in the printer body, in a mount direction against a biasing force of a biasing member, which is not illustrated.

When the separation roller separating projection 30*a* presses the separation roller support lever 35 in the above-described manner, the separation roller support lever 35 presses a separation roller holder projection 34*b* projecting from a side wall surface of the separation roller holder 34. Consequently, the separation roller holder 34 is supported in movement toward the feed roller on the turn shaft 34*a*, so that the separation roller 32 can be brought into press-contact with the feed roller 31.

Figure 4B:
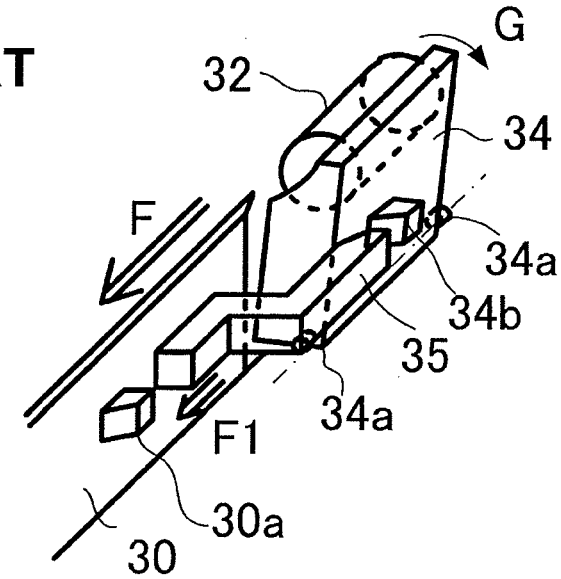
FIG. 4B PRIOR ART
FIG. 4B is another view illustrating the separating mechanism which separates the feed roller and the separation roller from each other in the sheet feeder of the feed roller pressurizing system in the prior art.

In the meantime, when the cassette 30 is pulled out in a direction indicated by an arrow F in FIG. 4B, the pressing by the separation roller separating projection 30*a* is released, and the separation roller support lever 35 is moved in a direction indicated by an arrow F1 together with the cassette 30 by the biasing force of the biasing member, which is not illustrated. In this manner, the support for the separation roller holder projection 34*b* is released, and the separation roller holder 34 is turned in a direction indicated by an arrow G on the turn shaft 34*a*, thereby separating the separation roller 32 from the feed roller 31. Here, FIG. 3C illustrates the state in which the sheet S is separated from the feed roller 31 and the feed roller 31 is separated from the separation roller 32.

Figure 5A:
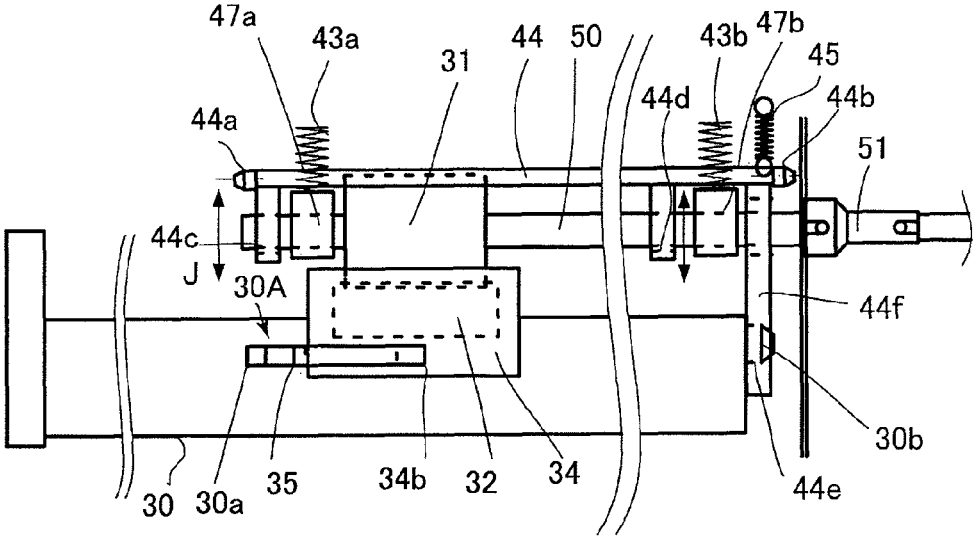
FIG. 5A is a second view illustrating the configuration of the sheet feeder.
Figure 5B:
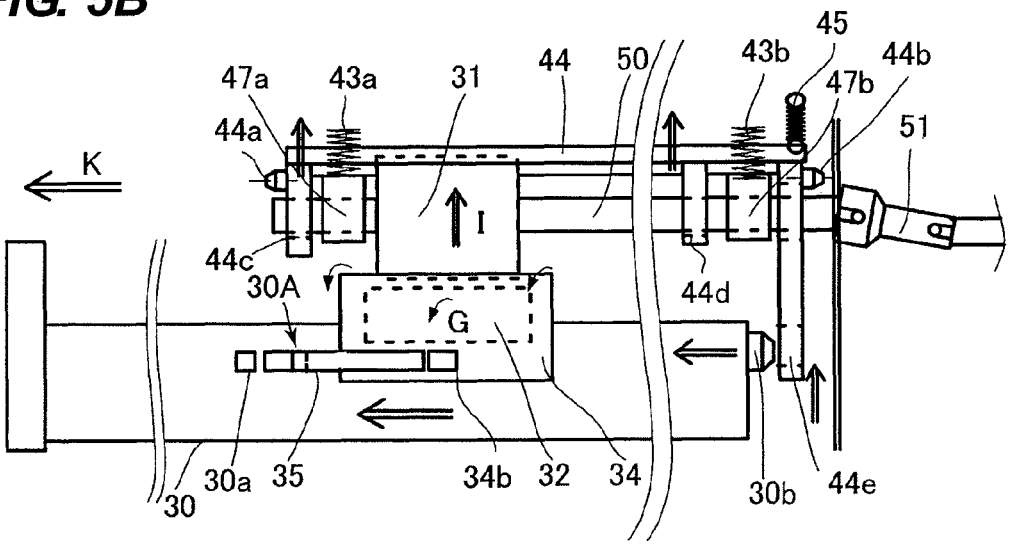
FIG. 5B is the second view illustrating the configuration of the sheet feeder.

As illustrated in FIG. 5B, when the cassette 30 is pulled out by the separation mechanism 30A in a direction indicated by an arrow K, the pressing by the separation roller separating projection 30*a* is released, and the separation roller support lever 35 is moved in the direction indicated by the arrow together with the cassette 30 by the biasing force of the biasing member, which is not illustrated. In this manner, the support for the separation roller holder projection 34*b* is released, and the separation roller holder 34 is turned in the direction indicated by the arrow G, thereby separating the separation roller 32 from the feed roller 31.

The feed roller 31 in the present embodiment is disposed in such a manner as to be vertically movable, and receives the force downward from the feed roller pressurizing spring 43, as described above. Therefore, there is a fear that the feed roller 31 follows the sheet S and the separation roller 32 that are to be separated even if the sheet S and the separation roller 32 are to be separated in association with the pulling operation of the cassette 30, so that the sheet S and the separation roller 32 cannot be separated or a separation timing is largely delayed.

In such a case, breakage or bending of the sheet occurs or the sheet remains inside of the apparatus. In other words, when the sheet containing portion (i.e., the cassette) is pulled out, the feed roller follows the sheet and the separation roller that are to be separated, and thus, the sheet is kept to be nipped between the feed roller and the separation portion, thereby generating the breakage or bending of the sheet or making the sheet remain inside of the apparatus.

In view of the foregoing, in the present embodiment, there is a restricting portion that restricts the feed roller 31 from following the separation roller 32 that is to be separated. Description on the restricting portion will be given below.

In FIGS. 2A, 2B, 5A and 5B, a feed roller separating arm 44 serves as a moving portion that moves the feed roller 31 upward. The feed roller separating arm 44 is supported by a frame, which is not illustrated, in the printer body 1A in such a manner as to be freely turned in the vertical direction on separation arm shafts 44*a* and 44*b*. Further, The feed roller separating arm 44 is applied a force upward by a feed roller separating spring 45 serving as a moving portion biasing member.

The feed roller separating arm 44 includes feed roller bearings 47 (47*a* and 47*b*) and shaft supporting portions 44*c* and 44*d* that support a feed roller shaft 50 from below in such a manner as to lift the feed roller 31 when the feed roller separating arm 44 is lifted, as described later. Here, in the present embodiment, the feed roller bearings 47 are applied a force toward the lifter plate 37 by feed roller pressurizing springs 43 (43*a* and 43*b*) serving as feed roller biasing portions. The feed roller 31 is applied a force toward the lifter plate 37 by the feed roller pressurizing springs 43 via the feed roller separating arm 44.

In this manner, when the upper surface of the uppermost sheet is lowered by lowering the position of the lifter plate 37, the feed roller 31 is lowered accordingly, so that the feed roller 31 can be brought into press-contact with the uppermost sheet.

As a consequence, even if the lifter plate 37 is lowered against the biasing force of the spring as a result of an increase in weight of the sheets, the sheet feeding force can be stably held. Specifically, the feed roller 31 is lowered as the lifter plate 37 is lowered, thereby preventing the sheet feeding force from being markedly reduced even in the case where the amount of stacked sheets is increased or the sheets having a great density are stacked.

Moreover, the feed roller separating arm 44 includes a locking portion 44*f* that extends in a vertical direction and has a separation arm positioning hole 44*e*, to which a separation arm positioning boss 30*b* formed at the cassette 30 is fitted. When the cassette 30 is inserted into the printer body 1A, the separation arm positioning boss 30*b* formed at the cassette 30 is fitted to the separation arm positioning hole 44*e* formed in the locking portion 44*f*, as illustrated in FIG. 5A.

Consequently, the feed roller separating arm 44 that receives a tension upward from the feed roller separating spring 45 is positioned against the biasing force of the feed roller separating spring 45. In this manner, a stopper that restricts the upward motion of the feed roller separating arm 44 against the biasing force of the feed roller separating spring 45 is constituted of the separation arm positioning boss 30*b* formed at the cassette 30 and the separation arm positioning hole 44*e* formed in the locking portion 44*f*. When the feed roller separating arm 44 is positioned in the above-described manner, the shaft supporting portions 44*c* and 44*d* formed at the feed roller separating arm 44 are brought out of contact with the feed roller shaft 50, and therefore, the feed roller 31 cannot be prevented from being rotated.

When the cassette 30 is pulled out of the printer body 1A in the direction indicated by the arrow K, the separation arm positioning boss 30*b* is released from the separation arm positioning hole 44*e*. At this instant, the restriction by the separation arm positioning boss 30*b* is released, and then, the feed roller separating arm 44 is turned on the separation arm shafts 44*a* and 44*b* upward in a direction indicated by an arrow H in FIG. 2B by the tension of the feed roller separation spring 45.

When the feed roller separating arm 44 is turned upward in the above-described manner, the shaft supporting portions 44*c* and 44*d* formed at the feed roller separating arm 44 lift the feed roller shaft 50. Accordingly, the feed roller 31 is lifted as indicated by an arrow I. Incidentally, in the present embodiment, the feed roller shaft 50 is connected to the motor, which is not illustrated, via a universal joint 51, as illustrated in FIGS. 5A and 5B, and therefore, the driving can be achieved even when the feed roller shaft 50 is lifted in the above-described manner.

As described above, when the cassette 30 is pulled out, the separation roller 32 is turned in the direction, in which the separation roller 32 is separated from the feed roller 31, in association with the movement of the cassette 30 by the separation mechanism 30A, and further, the feed roller 31 is lifted. In other words, when the cassette 30 is pulled out, the feed roller 31 is restricted from following the separation roller 32 that is to be separated by the restricting portion constituted of the feed roller separation arm 44 and the feed roller separation spring 45. Here, at the timing when the feed roller 31 is lifted, the lifter plate 37 is disconnected from the lifter idler gear 40, and is thus lowered down to a lowest position. Consequently, the sheet S and the feed roller 31 are separated from each other, too.

In this manner, in the present embodiment, when the cassette 30 is pulled out, the feed roller 31 is lifted, and further, the separation roller 32 is moved in the direction in which the separation roller 32 is separated from the feed roller 31. Moreover, the lifter plate 37 is lowered, so that the sheet S and the feed roller 31 are separated from each other. Accordingly, at feed standby time illustrated in FIGS. 2A and 5A, even when the sheet is nipped by the feed roller 31, the lifter plate 37, and the separation roller 32, the cassette 30 is pulled out while avoiding the sheet from being bent, broken, or remaining inside of the apparatus.

When the cassette 30 is mounted in the printer body 1A, the separation roller separating projection 30*a* formed in the cassette 30 presses the separation roller supporting lever 35, which then presses the separation roller holder projection 34*b* projecting from the side wall surface of the separation roller holder 34. Consequently, the separation roller holder 34 is moved toward the feed roller, and thus, the separation roller 32 is brought into press-contact with the feed roller 31.

Additionally, when the cassette 30 is mounted, the separation arm positioning boss 30*b* is fitted to the separation arm positioning hole 44*e* shifted laterally, as illustrated in FIG. 2B, at the time of disengagement since the tip of the separation arm positioning boss 30*b* is formed into a tapered shape. Along with the fitting of the separation arm positioning boss 30*b*, the feed roller separation arm 44 is turned downward on the separation arm shafts 44*a* and 44*b* against the tension of the feed roller separation spring 45, thereby being turnably restored to the position illustrated in FIG. 2A.

As described above, in the present embodiment, the feed roller 31 is configured to be applied a force to follow the lowering lifter plate 37. As a consequence, even when the amount of stacked sheets is increased or the sheets having a great density are stacked, the sheet feeding force by the feed roller 31 can be prevented from being markedly reduced.

In addition, when the cassette 30 is pulled out, the feed roller 31 is lifted such that the feed roller 31 cannot follow either of the lifter plate 37 and the separation roller 32 that are to be separated. In this manner, even when the cassette 30 is pulled out in the state in which the uppermost sheet S1 is nipped between the feed roller 31 and the lifter plate 37 and between the feed roller 31 and the separation roller 32, the sheet can be avoided from being bent, broken, or remaining inside of the apparatus.

Next, a description of a second exemplary embodiment according to the present invention will be given. FIGS. 6A, 6B, 7A, and 7B are views illustrating the configuration of a sheet feeder in the present embodiment. In FIGS. 6A, 6B, 7A, and 7B, the same reference numerals as those in FIGS. 2A, 2B, 5A and 5B designate the same or corresponding constituent elements.

In FIGS. 6A, 6B, 7A and 7B, a feed roller stopper 48 serves as a holding portion that holds a feed roller 31 in such a manner as to restrict the feed roller 31 from following, in a downward direction, a sheet S (i.e., a lifter plate 37) and a separation roller 32 that are to be separated when a cassette 30 is pulled out. The feed roller stopper 48 is slidably supported in a cassette mounting direction by a frame, which is not illustrated, and further as well as provided with pressing portions 48*a* and 48*b* which are freely brought into or out of contact with feed roller bearings 47 (47*a* and 47*b*), respectively, at both ends in the cassette mounting direction.

A feed roller stopper spring 49 is interposed between a locking portion 48*b* downstream in the cassette mounting direction in the feed roller stopper 48 and a side plate 53 downstream in the cassette mounting direction in a printer body 1A. The feed roller stopper spring 49 applies a force to the feed roller stopper 48 in a cassette pulling direction. Moreover, a feed roller support plate 52 is provided at both ends thereof with roller supporting portions 52*a* and 52*b* that turnably support the feed roller 31 in a manner movable in a vertical direction.

Here in the present embodiment, the feed roller bearings 47 (47*a* and 47*b*) are applied a force by feed roller pressurizing springs 43 (43*a* and 43*b*), which apply a force to the feed roller 31 toward the lifter plate 37. Moreover, the feed roller bearings 47 are supported by the roller supporting portions 52*a* and 52*b* in such a manner as to be movable in the vertical direction. Consequently, the feed roller 31 is supported by the roller supporting portions 52*a* and 52*b* via the feed roller bearings 47 in such a manner as to be movable in the vertical direction indicated by an arrow J. As a consequence, when the lifter plate 37 is lowered and accordingly the upper surface of an uppermost sheet is lowered, the feed roller 31 follows them in a downward direction so as to be brought into press-contact with the uppermost sheet.

Figure 7A:
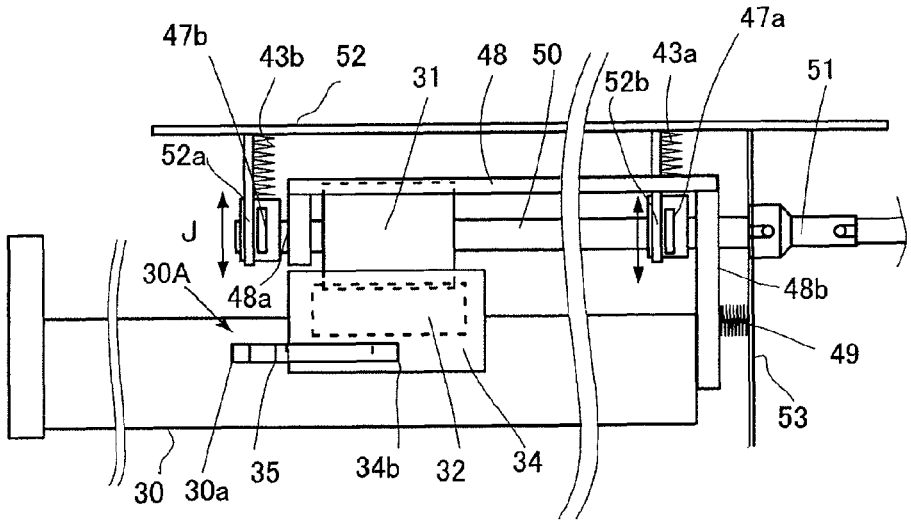
FIG. 7A is a second view illustrating the configuration of the sheet feeder.
Figure 7B:
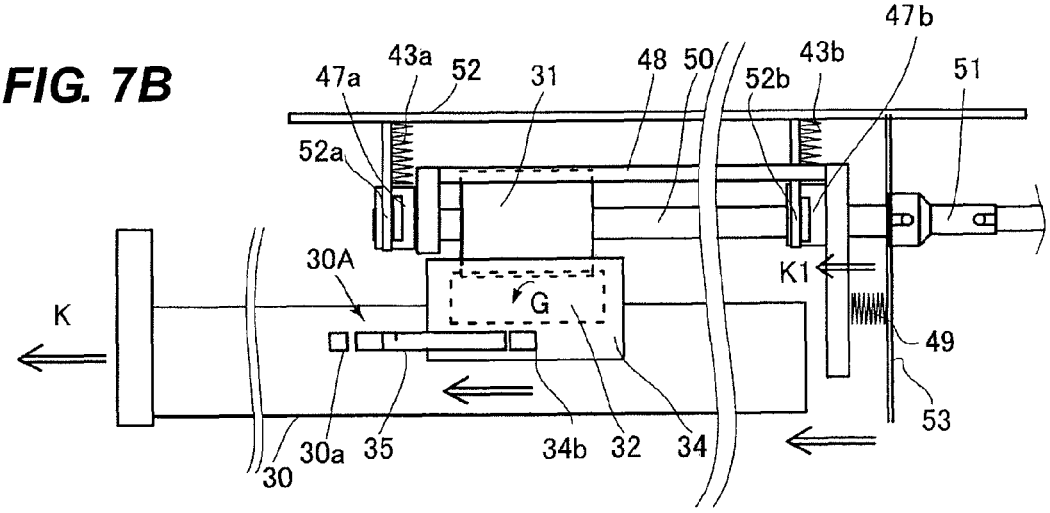
FIG. 7B is the second view illustrating the configuration of the sheet feeder.

As illustrated in FIG. 7A, when the cassette 30 is inserted into the printer body 1A, the cassette 30 pushes the pressing portion 48*a* of the feed roller stopper 48, thereby bringing the feed roller stopper 48 and the feed roller bearings 47 out of contact. In this state, the feed roller 31 is applied a force by the feed roller pressurizing spring 43 via the feed roller bearings 47 together with the feed roller shaft 50, and therefore, it can be moved downward.

In contrast, when the cassette 30 is pulled out of the printer body 1A in a direction indicated by an arrow K, the feed roller stopper 48 is pressed by the feed roller stopper spring 49, and then, slides in a direction indicated by an arrow K1 together with the cassette 30. In this manner, when the feed roller stopper 48 is moved, the pressing portions 48*a* and 48*b* of the feed roller stopper 48 and the roller supporting portions 52*a* and 52*b* of the feed roller support plate 52 nip the feed roller bearings 47*a* and 47*b* therebetween, respectively.

Consequently, the feed roller bearings 47*a* and 47*b* are resiliently held at the positions. Additionally, the feed roller 31 supported by the feed roller bearings 47 also is held at its current position at this time together with the feed roller shaft 50. Incidentally, the separation roller 32 is turned in a direction in separation from the feed roller 31 in association with the movement of the cassette 30 by a separation mechanism 30A; like in the above-described first embodiment.

In the present embodiment, a timing when the feed roller stopper 48 nips the feed roller bearings 47 is set to be earlier than a separation timing of the separation roller 32. Consequently, during a separating operation of the separation roller 32, the feed roller 31 is held at that position. Thus, even if the separation roller 32 is turned, the feed roller 31 cannot follow the separation roller 32. Therefore, when the separation roller 32 is turned, the separation roller 32 is separated from the feed roller 31. At this timing, the lifter plate 37 is lowered in disconnection from a lifter idler gear 40 so that the sheet and the feed roller 31 also are separated from each other, like in the above-described first embodiment.

In this manner, in the present embodiment, when the cassette 30 is pulled out, the feed roller 31 is held at its current position and further the separation roller 32 is moved in the direction where it is separated from the feed roller 31. The lifter plate 37 is lowered to separate the sheet S from the feed roller 31. Thus, even if the cassette 30 is pulled out when an uppermost sheet S1 is held by the feed roller 31, the lifter plate 37, and the separation roller 32 during the feed standby time illustrated in FIGS. 6A and 7A, the sheet can be avoided from being bent, broken, or remaining inside of the apparatus.

The above description of the system, in which the feed roller is applying pressure downward, has been given. However, the present invention may be applied to a system in which a feed roller is supported by a turnable arm that is applied a force in a turning direction. Alternatively, although the roller provided with the torque limiter has served as the separation member, a friction pad including a friction member may be used. In addition, although the separation member is separated by the turn system, the same effect can be produced by a vertical slide system.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-140345, filed Jun. 24, 2011, which is hereby incorporated by reference herein in its entirety.

What is claimed is:

1. A sheet feeder comprising:

a sheet containing portion that has a sheet stacking portion to be lifted and lowered and that is detachably attached to an apparatus body;

a feed roller that is located above the sheet stacking portion in a manner movable in a vertical direction so as to feed sheets stacked on the sheet stacking portion;

a feed roller biasing portion that applies a force to the feed roller in a direction in which the feed roller is brought into press-contact with the sheets, stacked on the sheet stacking portion;

a separation member that is brought into press-contact with the feed roller so as to separate the sheets fed by the feed roller one by one;

a separating portion that separates the separation member from the feed roller in association with a pulling operation of the sheet containing portion from the apparatus body;

a lifting and lowering portion that lifts the sheet stacking portion in such a manner that an upper surface of the sheet is located at a predetermined height during a sheet feeding operation whereas lowers the sheet stacking portion in association with the pulling operation of the sheet containing portion when the sheet containing portion is pulled out of the apparatus body; and a restricting portion that restricts the feed roller being applied a force by the feed roller biasing portion from following the separation member separated from the feed roller and the lowering sheet stacking portion when the sheet containing portion is pulled out of the apparatus body.

2. The sheet feeder according to claim 1, wherein the restricting portion includes:

a moving portion that is disposed in a manner movable in a vertical direction so as to move the feed roller upward when the moving portion is moved upward;

a moving portion biasing member that applies a force to the moving portion upward; and a stopper that restricts the upward movement of the moving portion against a biasing force of the moving portion biasing member; and wherein the restriction by the stopper is released when the sheet containing portion is pulled out of the apparatus body, and further, the biasing member lifts the moving portion in such a manner as to restrict the feed roller from following the separation member and the sheet stacking portion.

3. The sheet feeder according to claim wherein the restricting portion includes:

a holding portion that is disposed in a manner movable along a direction in which the sheet containing portion is mounted and holds the feed roller so as to restrict the feed roller from being lowered when the restricting portion is moved in the direction in which the sheet containing portion is pulled out; and a biasing member that applies a force to the holding portion in the direction in which the sheet containing portion is pulled out; and wherein the holding portion is moved to a position at which the feed roller is held by the biasing force of the biasing member when the sheet containing portion is pulled out of the apparatus body, so as to restrict the feed roller from following the separation member and the sheet stacking portion.

4. The sheet feeder according to claim 3, wherein the holding portion resiliently holds the feed roller by the biasing force of the biasing member when the holding portion is moved to the position at which the feed roller is held.

5. An image forming apparatus that forms an image on a sheet fed from a sheet feeder in an image forming portion, the sheet feeder comprising:

a sheet containing portion that has a sheet stacking portion to be lifted and lowered and that is detachably attached to an apparatus body;

a feed roller that is located above the sheet stacking portion in a manner movable in a vertical direction so as to feed sheets stacked on the sheet stacking portion;

a feed roller biasing portion that applies a force to the feed roller in a direction in which the feed roller is brought into press-contact with the sheets stacked on the sheet stacking portion;

a separation member that is brought into press-contact with the feed roller so as to separate the sheets fed by the feed roller one by one;

a separating portion that separates the separation member from the feed roller in association with a pulling operation of the sheet containing portion from the apparatus body;

a lifting and lowering portion that lifts the sheet stacking portion in such a manner that an upper surface of the sheet is located at a predetermined height during a sheet feeding operation whereas lowers the sheet stacking portion in association with the pulling operation of the sheet containing portion when the sheet containing portion is pulled out of the apparatus body; and a restricting portion that restricts the feed roller being applied a force by the feed roller biasing portion from following the separation member separated from the feed roller and the lowering sheet stacking portion when the sheet containing portion is pulled out of the apparatus body.

6. The image forming apparatus according to claim 5, wherein the restricting portion includes:

a moving portion that is disposed in a manner movable in a vertical direction so as to move the feed roller upward when the moving portion is moved upward;

a moving portion biasing member that applies a force to the moving portion upward; and a stopper that restricts the upward movement of the moving portion against a biasing force of the moving portion biasing member; and wherein the restriction by the stopper is released when the sheet containing portion is pulled out of the apparatus body, and further, the biasing member lifts the moving portion in such a manner as to restrict the feed roller from following the separation member and the sheet stacking portion.

7. The image forming apparatus according to claim 5, wherein the restricting portion includes:

a holding portion that is disposed in a manner movable along a direction in which the sheet containing portion is mounted and holds the feed roller so as to restrict the feed roller from being lowered when the restricting portion is moved in the direction in which the sheet containing portion is pulled out; and a biasing member that applies a force to the holding portion in the direction in which the sheet containing portion is pulled out; and wherein the holding portion is moved to a position at which the feed roller is held by the biasing force of the biasing member when the sheet containing portion is pulled out of the apparatus body, so as to restrict the feed roller from following the separation member and the sheet stacking portion.

8. The image forming apparatus according to claim 7, wherein the holding portion resiliently holds the feed roller by the biasing force of the biasing member when the holding portion is moved to the position at which the feed roller is held.

* * * * *